United States Patent [19]

Sawicki

[11] Patent Number: 4,475,833

[45] Date of Patent: Oct. 9, 1984

[54] WEB AND SHEET PAPER FEED MECHANISM FOR PRINTERS

[75] Inventor: Zbigniew-Igor Sawicki, Munich, Fed. Rep. of Germany

[73] Assignee: Siemens Aktiengesellschaft, Berlin & Munich, Fed. Rep. of Germany

[21] Appl. No.: 510,325

[22] Filed: Jul. 1, 1983

[30] Foreign Application Priority Data

Jul. 15, 1982 [DE] Fed. Rep. of Germany ..... 3226510

[51] Int. Cl.[3] ..... B41J 13/10

[52] U.S. Cl. ..... 400/605; 400/642; 271/274; 226/171; 226/196

[58] Field of Search ..... 400/605, 616.1, 616.2, 400/622, 629, 635–636, 636.3, 637–637.1, 638, 642; 271/274; 226/171–172, 198–199, 196

[56] References Cited

U.S. PATENT DOCUMENTS

| | | | |
|---|---|---|---|
| 3,176,819 | 4/1965 | Bloom, Jr. et al. | 400/605 |
| 3,407,981 | 10/1968 | Staugaard | 226/171 |
| 3,722,655 | 3/1973 | Singer | 400/636 |
| 4,030,726 | 6/1977 | Biedermann | 400/637.1 |
| 4,058,496 | 11/1977 | Rempel | 400/616.1 |
| 4,164,376 | 8/1979 | Yarp | 400/642 |
| 4,275,969 | 6/1981 | Matsuhisa et al. | 400/642 |
| 4,317,565 | 3/1982 | Swette | 271/274 |
| 4,326,815 | 4/1982 | Kapp | 400/629 |
| 4,412,637 | 11/1983 | Berger | 226/172 |
| 4,437,780 | 3/1984 | Weber et al. | 400/642 |

FOREIGN PATENT DOCUMENTS

| | | | |
|---|---|---|---|
| 2717758 | 10/1978 | Fed. Rep. of Germany | 400/605 |
| 2370596 | 7/1978 | France | 400/642 |

OTHER PUBLICATIONS

"Paper Feed Roller & Transport" IBM Technical Disclosure Bulletin, vol. 22, No. 6, Nov. 79, pp. 2230–2231.

"Cut-Forms Guide" IBM Tech. Disclosure Bulletin, vol. 23, No. 7B, Dec. 1980, pp. 3109–3110.

*Primary Examiner*—E. H. Eickholt

*Attorney, Agent, or Firm*—Hill, Van Santen, Steadman & Simpson

[57] ABSTRACT

A universal paper transport mechanism for feeding both continuous form and single sheet paper to a printer includes pin belt tractors longitudinally displaceable along a guide bar transversed to the direction of movement of the paper, the tractor is driven from a laterally positioned motor. The tractor drive transport mechanism is pivotable from a horizontal position to a vertical position and attachable and detachable guiding elements are provided for use with single sheet paper, and are affixable to the tractor transport mechanism in an area adjacent and above a printing station area. The guiding elements are substantially symmetrical relative to one another and can be attached to the guide strip of the tractor transport mechanism on which the individual pin belt tractor assemblies are guided.

17 Claims, 6 Drawing Figures

WEB AND SHEET PAPER FEED MECHANISM FOR PRINTERS

BACKGROUND OF THE INVENTION

1. Field of the Invention

This invention relates to printer mechanisms and more particularly to a paper transport system for printer mechanisms.

2. Prior Art

Printers, such as the type used in connection with electronic data processing systems or so-called hard copy printers, and particularly matrix printers, are normally utilized in connection with continuous form paper and therefore are provided with motor driven transport devices for moving the continuous form paper past a printing station area. Such transport devices frequently consist of two pin belt tractors which are displaceable along a guide strip and received around drive shafts. The guide strip extends transversely of the direction of movement of the paper past the printing station area as do the drive shafts. By making the tractor assemblies movable, it is possible to accommodate varying widths of paper. Such transport devices are disclosed, for example, in German OS No. 28 27 125.

Since such printers are often desired to be used in connection with single sheets of paper, or in connection with multi-sheet form paper, such as carbon copy sets, it has been known to design the tractor transport mechanism so as to be removable from the remainder of the printer. In such cases, the transport device, including the paper tractors and the allocated motor drive, are removable from the main portion of the printer and are then replaced by means specifically designed for single sheets, such as platen assemblies.

When such prior art printers are used in connection with multiple form sets, a problem arises in that the individual copies of the multiple form set may shift relative to one another, so that non-aligned printing will be reproduced on underlying form sheets. Moreover, in systems that require an exchange of different mechanisms, one for tractor transport of continuous paper forms, such as side margin perforated papers, and one for single sheet or multi-carboned forms, change over is cumbersome and it is necessary for storage space to be provided adjacent the printer for storage of the non-presently used mechanism. Of course, additionally, removal and exchange provide opportunities for mechanism damage.

It would therefore be an advance in the art to design a paper transport assembly for printers such that the assembly is readily utilizable with minor modifications for both transporting individual sheets and continuous paper and which is utilizable in a standard format fashion which minimizes the misalignment of multiple form sets.

SUMMARY OF THE INVENTION

It is a principal object of this invention to provide a transport mechanism for line-at-a-time printers, which includes paper tractors for use with continuous form paper, the paper tractors being movable along a guide member normal to the path of movement of the paper to accommodate various width papers and which further includes attachable means for properly guiding single sheet paper independent of the tractor drive without removal of the tractor drive.

A transport mechanism for continuous form paper can be converted to a transport mechanism for single sheets or for form sets by means of two channel defining side elements consisting of injection molded members which are attachable to the guide strip guiding the paper tractors of the pin belt tractor mechanism when the tractor mechanism is in a perpendicular position with respect to the printer.

To facilitate such a conversion, the transport means for the continuous form paper is pivotably fastened to the printer in the illustrated preferred embodiment. This allows the tractor transport assembly to operate both in a horizontal position when desired and in a vertical position vis-a-vis the print station area. When in a vertical position, attachment of single sheet guiding elements will not only be facilitated but, further, the single sheet paper will be advantageously moved vertically past the print position. Also, when printing on continuous or single multi-form sets with the single sheet feed guiding elements, the vertical positioning will assure that no relative offset of the copies with respect to one another will occur.

In a further embodiment of the invention, paper transport shafts carrying paper transport pinch rollers can be provided positioned below the printing area to provide an under roll intake. Such under roll intakes are favored, for example, for transporting continuous multi-form and single sheets. By means of an appropriate drive coupling, the drive of the paper transport under roll shafts can drive from the motor allocated to the pin belt tractors.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
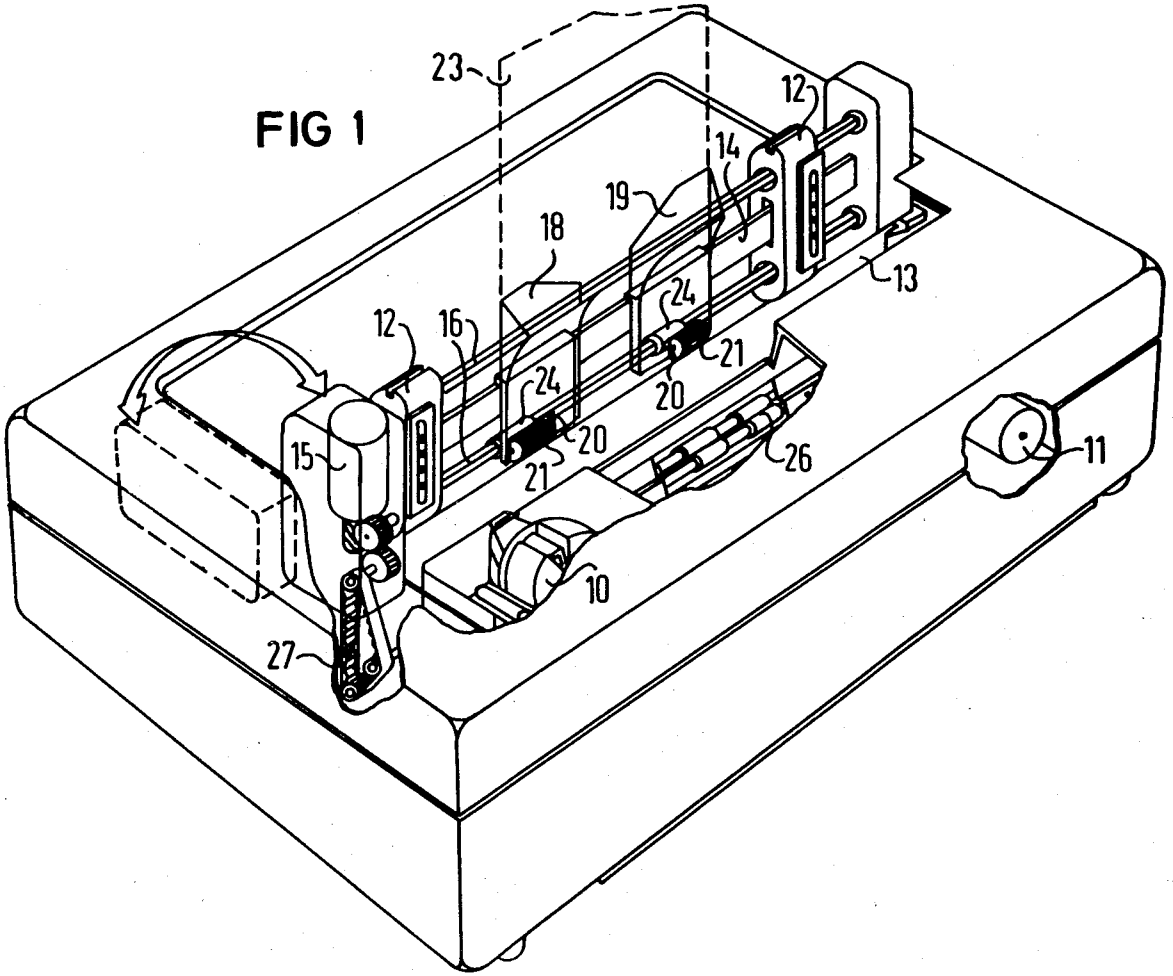
FIG. 1 is a schematic perspective view, with portions broken away to show underlying portions of a matrix printer equipped with the paper transport mechanism of this invention.

FIG. 1 schematically illustrates a printer of the type utilizable both in connection with continuous form margin perforated paper and single sheet paper, as well as multi-copy sets. The printer includes a dot matrix printhead 10 which is movable from side to side of the printer to form a line of print. The print head 10 is moved by motor 11.

When printing on continuous form paper, the paper is moved past the print station by a tractor transport mechanism consisting of pin belt tractor assemblies 12. The tractor assemblies 12 are mounted on shafts 16 which may carry gear wheel shieves for movement of the tractor belt. A transverse bar 14 is provided for guidance of the pin belt tractor assemblies 12 and the tractor assemblies are movable towards and away from one another along the guide bar 14.

As illustrated in FIG. 1, the entire tractor assembly is pivotable from the vertical position illustrated to a horizontal position. The drive to the tractor shafts is by means of motor 15 which may drive a gear train to one of the shafts. In the horizontal position, the position of the motor 15, which is disposed at one lateral side of the tractor transport mechanism would be illustrated by the broken lines at the end of the curved arrow.

Printing is accomplished by placing a piece of paper between the dot matrix printer head assembly 10 and an opposed backup or beam member 13. It is therefore the function of the paper transport mechanisms to move the paper, line by line, between the print head 10 and the beam 13.

Preferably, when using continuous form paper, the transport mechanism can be in its horizontal position. In such instance, the paper may enter from the rear of the printer, pass between a clamp element and the pin belt on the underside of the pin belt tractor, then around the beam 13, then between a clamp member and the pin belt on the top side of the pin belt tractor and back toward the rear of the printer. The pin belt tractors being movable in reverse directions can cause the paper to be advanced or retracted as necessary.

Figure 2:
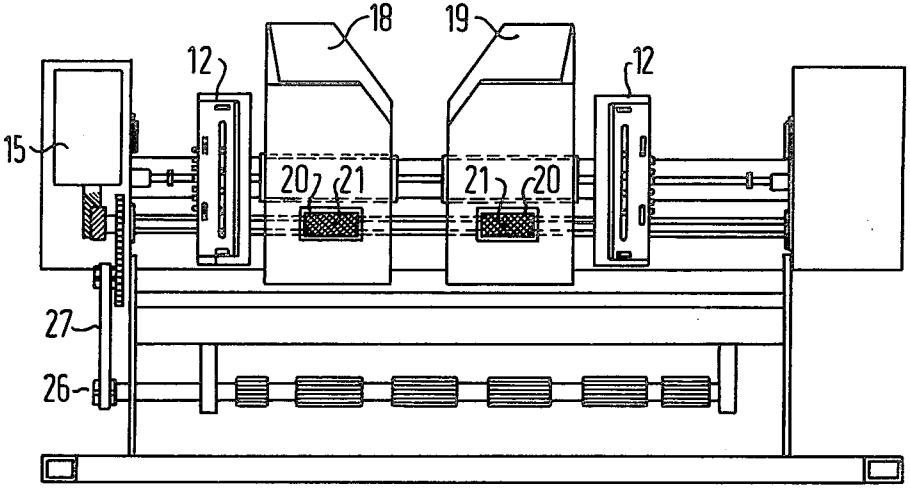
FIG. 2 is a schematic sectional view of the printer of FIG. 1 illustrating the paper transport mechanism.
Figure 4:
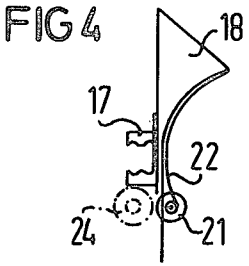
FIG. 4 is a schematic side view of a guiding element.

However, since single sheets are generally not provided with margin perforations engageable by the pin belt, it is generally preferable to feed the single sheets in a substantially vertical position and to positively feed them by means of pinch rollers. In order to facilitate both vertical feeding and positive pinch roller feeding, the tractor transport mechanism, including the guide bore bar 15, is pivotable to a vertical position. Guide elements 18 and 19 provided with clips 17, can then be clipped onto the guide bar 14. The guide elements 18 and 19 are laterally displaceable along the guide bar 14 and are designed symmetrical relative to one another, providing somewhat U-shaped cross-sectional channels having their open ends facing towards one another substantially as shown in FIG. 2. The guiding elements may be somewhat funnel shaped in cross-section having a relatively large top opening decreasing in depth to a main channel lower portion. The front face of the guide elements may be provided with recesses which contain spring biased pressure rolls 21. The pressure rolls can be aligned with opposed rolls 24 carried on one of the shafts 16. In order to accommodate different size widths, the rolls 24 can be longitudinally movable along the shaft 16. The rolls 24 are thereby powered rolls powered by rotation of the shaft 16 under influence of the motor 15 with the opposed spring rolls 21 functioning to provide a pressure roll set to press a single sheet 23 introduced between the guiding elements against the drive rollers 24 for controlled movement.

Figure 5:
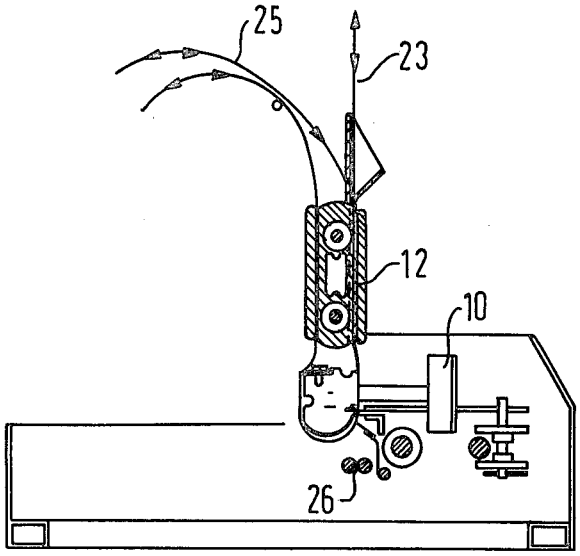
FIGS. 5 and 6 are diagrammatic schematic views of the printer of this invention equipped with paper transport mechanism of this invention showing paper flow paths.

The overall paper transport channel is designed such that when in the vertical position, as illustrated in FIG. 5, the paper passage channel lies directly over the print position. As a result of such a design of the paper transport channel, the paper, whether single sheet or continuous form paper, is conducted vertically past the print position. Thus, no offset will occur in multi-copy sets. In addition, such a design promotes and facilitates proper feed of the paper in both feed directions.

By utilization of this transport mechanism, various operating modes are possible. As shown in FIG. 5, continuous form paper 25 can be moved both forward and backward around the print beam 13 under influence of the tractors 12. Such back and forth movement is advantageous, for example, when filling out forms. Additionally, a single sheet 23 can be also moved back and forth in the vertical direction when the guiding elements are in position.

Figure 3:
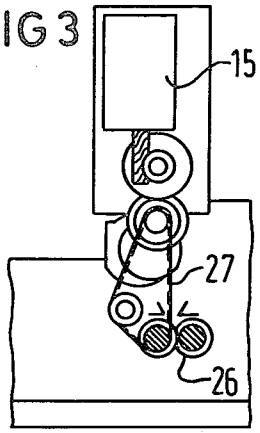
FIG. 3 is a fragmentary partial side schematic view of the drive mechanism for the paper transport mechanism.
Figure 6:
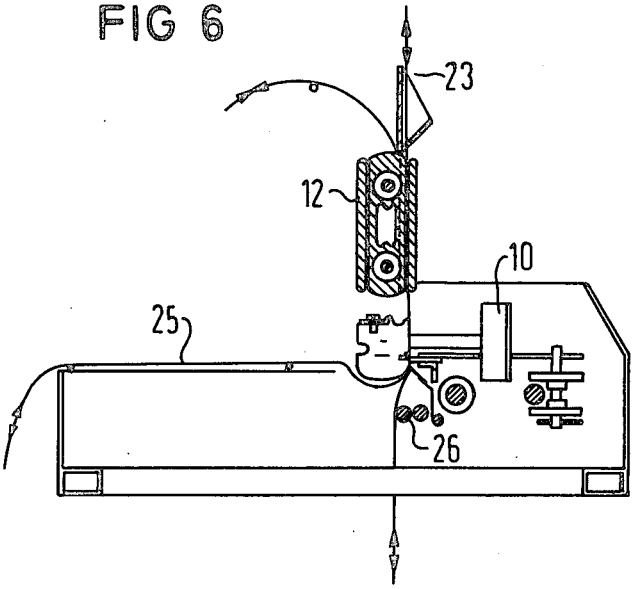

When employing multiple sets and label carriers, it is advantageous to provide an additional guidance within the printer to provide a paper feed from below. To this end, and under roll entry can be provided in the bottom of the printer and opposed pressure rollers 26, consisting of two paper transport shafts and associated rollers, can be provided below the printing area. As shown in FIG. 3, the shafts 26, or one of them, can be commonly driven from the motor 15 by means of a gear train which may employ a drive belt 27. The rollers 26 can operate in conjunction with the rollers 20, 21 or independently thereof. When used in conjunction with the rollers 20, 21, due to the spacing of the paper across the print head and the relatively short spacing distance between the drive rollers 20, 21, and the rollers 26, an up and down movement of the paper is greatly facilitated. Additionally, it will be appreciated that due to the vertical movement, a misalignment of copy sets in multi-form sets, whether single or continuous form, is avoided. Of course, as shown in FIG. 6, it is possible to employ only the rollers 20, 21 and to bypass the rollers 26 while still using the bottom entry if desired.

An advantage of this invention is the provision of a single drive motor 15 operating all of the paper transport mechanisms, the pin belt tractors 12, the single sheet pressure rollers 20, 21, and the bottom entry rollers 26. Moreover, because the motor is disposed laterally of the mechanism, it can be dimensioned substantially as large as desired.

Although the teachings of my invention have herein been discussed with reference to specific theories and embodiments, it is to be understood that these are by way of illustration only and that others may wish to utilize my invention in different designs or applications.

I claim as my invention:

1. A paper transport mechanism for line by line printers comprising a pin belt tractor drive assembly including pin belt tractors mounted on drive shafts extending widthwise of the printer, a guide strip extending widthwise of the printer along which the tractors are movable, single sheet guide elements fixable to said guide strip, said guide elements defining a paper guidance channel therebetween, said guide elements removable from said printer, said tractor transport mechanism pivotable from a horizontal to a vertical position, said guide elements, when attached to said guide strip, and when said tractor transport mechanism is in the vertical position being position substantially vertically above a printing station area for vertical feed of sheets of paper between said guide elements, said guide elements including pressure rollers cooperating with one of said drive shafts for controlling movement of paper positioned between said guide elements.

2. In a paper transport mechanism for use with moving print head printers employing pin belt tractors driven by at least one drive shaft, the tractors movable along a guide bar affixed to the printer, the shaft and guide bar extending tranverse of the printer parallel to a line of movement of the print head through a printing station area, the improvement of the guide bar and shaft being positionable adjacent to and above the printing station area, single sheet guiding elements dettachably affixable to the guide bar above the printing station area, said guiding elements defining a vertically disposed paper guiding channel above the printing station area, spring biased roller means carried by said guiding elements, opposed roller means carried by said drive shaft, the roller means and opposed roller means providing a paper drive for paper received in said channel.

3. The print mechanism of claim 2 wherein the pin belt tractors are affixed to said guide bar and are pivotable from a substantially horizontal to a substantially vertical position.

4. A mechanism according to claim 3 wherein said guiding elements are funnel shaped in cross section having a top opening of greater front to rear dimension than a lower portion, the lower portion including said rollers, the guide elements having front and back walls, said rolling means carried by said front wall, the guiding elements having at least one side wall interconnecting the front and back walls and defining a U-shaped paper guiding channel.

5. A device according to claim 2 including opposed driving and pinch rollers positioned beneath said printing station area substantially aligned with said guiding elements, said printer having a bottom opening thereto for vertical feeding of paper through said pinch and driving rollers, past said printing station area and through said rollers and opposed rollers.

6. A device according to claim 4 including opposed driving and pinch rollers positioned beneath said printing station area substantially aligned with said guiding elements, said printer having a bottom opening thereto for vertical feeding of paper through said pinch and driving rollers, past said printing station area and through said rollers and opposed rollers.

7. A device according to claim 6 wherein said drive shaft and said driving roller are commonly driven from a single laterally positioned motor, the motor being pivotable with said tractors.

8. A device according to claim 6 wherein the transport mechanism includes a pair of drive shafts positioned on either side of the guide bar, the drive shafts having ends terminating in side members pivotably affixed to a main portion of the printer, one of said side portions containing a housing for said motor, and said side portions, shafts and guide bar all being pivotable from a substantially horizontal position to a substantially vertical position, the guiding elements being affixable to the guide bar with a major portion of the guiding elements forward of the guide bar and shafts, the guiding elements being affixable to the guide bar at various positions along the length of the guide bar.

9. A paper transport means for use with line at a time printers having transport means for continuous form paper, including paper tractors motor driven by drive shafts and guided by a guide strip effective to move a recording medium through a printing area, the printing area including a movable print head and opposed print beam, the improvement of additional transport means for single sheets, the additional transport means being affixable to the guide strip and being vertically disposed above the printing area, the additional transport means defining funnel shaped guidance channels open at bottoms thereof to the printing area and being vertically disposed providing vertical feed of paper received therein, the additional transport means for single sheets including resilient pressure elements positioned in the area of the paper guidance channels and effective to press paper received therein against a drive shaft of the tractors.

10. A device according to claim 9 wherein the transport means for continuous form paper is pivotably attached to the printer movable from a horizontal position to a substantially vertical position.

11. A device according to claim 9 wherein the tractors are movable along the length of the guide strip to accommodate varying width papers.

12. A device according to claim 10 wherein the transport means for single sheets consists of a pair of symmetrically formed opposed channel defining members.

13. A device according to claim 11 wherein the channel defining members include latch elements for affixing the channel defining elements to the guide bar.

14. A device according to claim 12 wherein the printer is provided with a bottom paper entry to the printing area and opposed drive and pressure rollers are positioned between the bottom entry and the printing area substantially vertically below the printing area, the drive roller being motor driven.

15. A device according to claim 13 wherein a single motor drives the drive shafts of the tractors and the drive roll.

16. A device according to claim 11 wherein the pressure elements are resiliently seated in openings through a front wall of the channel defining members.

17. A printer for use with continuous form and single sheet paper comprising a printer housing, a paper transport mechanism carried by said printer housing, the transport mechanism including pin belt tractor drives, a common drive shaft for said pin belt tractor drives, the drive shaft extending substantially across the width of the printer housing, the pin belt tractors movable along the length of said shaft to accommodate various width papers, the tractors pivotable from a position substantially horizontal to a position substantially vertical and lying substantially vertically above a print station area when in the vertical position, single sheet U-shaped cross section guiding elements removably affixable to the transport mechanism when the transport mechanism is in the vertical position and including pressure rollers spring biased towards said shaft effective to entrap a single sheet between said pressure rollers and said shaft for controlled movement thereof to the print station, said printer further including a bottom entry vertrically below the print station and opposed drive and pressure rollers below said print station substantially vertically aligned with said single sheet guiding means.

* * * * *